US007309226B2

(12) United States Patent
Hansen et al.

(10) Patent No.: US 7,309,226 B2
(45) Date of Patent: Dec. 18, 2007

(54) MOULDING EQUIPMENT WITH CORES FOR CONCRETE CASTING MACHINES

(75) Inventors: Erik Spangenberg Hansen, Oestbirk (DK); Jesper Bjoern Rasmussen, Brabrand (DK)

(73) Assignee: KVM Industrimaskiner A/S, Kjellerup (DK)

( * ) Notice: Subject to any disclaimer, the term of this patent is extended or adjusted under 35 U.S.C. 154(b) by 310 days.

(21) Appl. No.: 10/545,007

(22) PCT Filed: Feb. 11, 2004

(86) PCT No.: PCT/DK2004/000099

§ 371 (c)(1),
(2), (4) Date: Aug. 10, 2005

(87) PCT Pub. No.: WO2004/071732

PCT Pub. Date: Aug. 26, 2004

(65) Prior Publication Data

US 2006/0134254 A1 Jun. 22, 2006

(30) Foreign Application Priority Data

Feb. 11, 2003 (DK) ..... 2003 00197

(51) Int. Cl.
*B28B 7/00* (2006.01)

(52) U.S. Cl. ..... 425/255; 425/414; 425/421; 425/432; 425/456

(58) Field of Classification Search ..... 425/255, 425/412–414, 421, 424, 211, 425–432, 456
See application file for complete search history.

(56) References Cited

U.S. PATENT DOCUMENTS

| | | | | |
|---|---|---|---|---|
| 2,667,679 A | | 2/1954 | Jackman | |
| 4,022,556 A | * | 5/1977 | Goetjen | 425/432 |
| 4,218,206 A | | 8/1980 | Mullins | |
| 4,261,693 A | | 4/1981 | Rayner et al. | |
| 4,545,754 A | * | 10/1985 | Scheidt et al. | 425/457 |

(Continued)

FOREIGN PATENT DOCUMENTS

DE 2710642 A * 9/1978

(Continued)

*Primary Examiner*—Yogendra N Gupta
*Assistant Examiner*—Thu Khanh T. Nguyen
(74) *Attorney, Agent, or Firm*—David S. Safran

(57) ABSTRACT

In connection with casting concrete blocks with cavities, e.g. foundation blocks, perforated blocks and elements with cavities, a moulding equipment including a bottom part (4) with casting cells with pendant core members (8) bolted on corresponding to the shape of the concrete block, and a top part (14) which have pressing plates (20) projecting downwards on support rods (18) and substantially corresponding to the shape of the casting cells, and so that the pressing plates (20) by stripping the items by vertical displacement of the bottom part (4) are passed down through the casting cells (6). By the invention is indicated a bottom part (4) that include means in the form of core members (8) bolted on, forming the defined cavities in the finished block/element. The core members (8) may either be releasably bolted onto the top plate (10) of the bottom part, or, alternatively, be suspended from a yoke (12) which is releasably fastened to the mould frame, and between the mould frame and the yoke there may be a vibration dampening shim. Core members (8) may furthermore be bolted on with a vibration dampening or compact shim (2).

12 Claims, 7 Drawing Sheets

U.S. PATENT DOCUMENTS

| | | | | |
|---|---|---|---|---|
| 4,793,587 | A | | 12/1988 | Berger |
| 5,139,409 | A | * | 8/1992 | Bevan et al. ..... 425/417 |
| 5,445,514 | A | | 8/1995 | Heitz |

FOREIGN PATENT DOCUMENTS

| | | | |
|---|---|---|---|
| DE | 2710643 | A * | 9/1978 |
| DE | 295 15 835 | U1 | 3/1997 |
| DE | 197 01 590 | A1 | 7/1998 |
| DE | 101 46 344 | A1 | 4/2003 |
| EP | 0 027 376 | A1 | 4/1981 |
| FR | 2 517 246 | | 6/1983 |
| FR | 2 700 289 | A1 | 7/1994 |
| WO | WO 91/08091 | A1 | 6/1991 |

* cited by examiner

MOULDING EQUIPMENT WITH CORES FOR CONCRETE CASTING MACHINES

BACKGROUND OF THE INVENTION

The present invention concerns concreting machines of the kind typically used for making cast items with cavities or corings in the shape of concrete blocks for erecting walls and elements, including a cellular bottom part with cells opening upwards as well as downwards which define the desired basic shape of the individual blocks and elements, and where the bottom part includes at least one core member placed in respective cells where the said cavities/corings in the mould are desired to be disposed, and a corresponding top part which have pressing pistons projecting downwards from an upper holding plate and formed with lower pressing plates that fit down into respective underlying cells in the bottom part and are thereby usable for downwards ejection of the cast items from the cells, and where the bottom part includes means ensuring that the core members keep their position in the bottom part.

The equipment is used in the way that the bottom part is placed on a casting board placed on a vibrating table with the top part in elevated position above the bottom part. A concrete supply car is guided along the upper side of the bottom part in the space below the top part for bringing concrete into the casting cells for filling up the latter with concrete. After finishing the filling, the supply car is pulled out, and the top part is lowered until the said pressing plates hit down on the concrete surfaces in the respective casting cells. Then the top part is utilised as a multi-pressure piston for consolidating the concrete mass in individual casting cells, which will occur under strong vibration of the moulding equipment in order to liberate air from the concrete mass. Hereby the concrete items are consolidated to the desired compact block shape and uniform thickness. Then the top part is retained in its top position in relation to the bottom part, and the bottom part is acted on by force for being lifted up from the casting board, whereby the cast items, which by the pressure maintained from the top part cannot participate in this elevation, will remain standing on the casting board during the stripping. When the stripping has ended by upwards displacing of the bottom part to a position, in which its underside is elevated to at least the level of the pressing plates of the top part, the semi-solid cast items can be removed from the vibrating table by pushing out therefrom after lifting the top part, after which a new casting cycle can be commenced subsequent to lowering the bottom part to the casting board and elevating the top part to its starting position.

In connection with casting concrete blocks with cavities, e.g. foundation blocks, perforated blocks and elements with cavities, there is used a moulding equipment including a bottom part with casting cells with pendant cores corresponding to the desired shape of the cavity/coring in the concrete block and a top part with pressing plates pendant from support bars and substantially corresponding to the shape of the casting cells, and so that the pressing plates by stripping the items by vertical displacement of the bottom part are passed down through the casting cells.

From DE-A-19 701 590 is known a traditional moulding equipment On a casting plate, e.g. placed on a vibrating table, a mould frame is secured. The mould frame is arranged with the desired number of partitionings in order thereby to cast a number of elements. After placing the partitionings in the mould, a number of cores are placed from above for providing corings in the finished elements.

The cores are fastened in a core holding element which bear on and is fastened to the mould frame. The casting mass, typically concrete, is then placed in the mould, after which mould with casting mass are vibrated. After finishing consolidation, stripping is performed by the mould frame with the cellular insert being elevated, whereby the cores are drawn up by means of the core holder element, after which the cast elements remain on the casting plate.

Traditionally, core members have been welded to a support of a core iron, which in turn has been welded to the mould frame with the cells. Alternatively, the core members have been welded to a supporting yoke, a structure above the mould which has carried the core member by downwards projecting rods.

The drawback of the welded core member is that after the required hardening of the welded core member, welding is performed again on the support iron of the core member for fastening the core member in the mould frame itself. By welding the already hardened core member, stresses arise in connection with the welding, and these stresses may give rise to breakage later. Another drawback is that substitution of the core member when worn-out, is made difficult, since the welding is to be ground before the new core member can be welded in. Repeating this welding weakens the mould frame and depreciates its service life. The problem is particularly outspoken by core members that do not abut on or are in contact with one of the sides of the cells in the bottom part, and may thus not be fastened to the walls in the cells; in the following, these core members are designated 'centre core members'.

By the invention, a bottom part including new means for securing said core members to remain in their position in the bottom part. These means may in a first embodiment be constituted by at least one top plate supported by and releasably fastened to the bottom part, and that the core members are fastened to the top plate, preferably by bolt connections.

The novel feature of the invention is that the core members forming part of the mould are fastened directly to the top plate, preferably by bolts. The above weldings are hereby avoided when mounting and exchanging the core members, which will imply weakening of the mould frame.

The core members that are bolted to the top plate typically include one or more intermediate pieces.

In cases where the top plate supports one or more centre core members, which are not in contact with the sides of a cell, the centre core member/members are carried, according to the invention, by through-going supports in the top plate which in turn is carried releasably fastened to the core members in contact with opposite cell sides and fastened in the cell sides, preferably also by bolt connections. Where these integrated supports run, the pressing plates of the top part are thus not coming into contact with the block items cast in the mould, making the surfaces of the item appear slightly uneven, but this has no practical significance as these surfaces on the end product are hidden.

In connection with this design of the top plate, the pressing plates in the top part are divided into several pieces.

If cast items of the kind already described, where all surfaces are smooth, are wanted to be produced, the design of the bottom part may alternatively be made so that the top plate on the centre core member/members is fastened to a supporting yoke which is supported and flexibly attached to the bottom part The supporting yoke substitutes the integrated centre core supports.

The difference of the core being bolted on the top plate or on the yoke is that if the core is bolted to the top plate, the pressing plates of the top part become divided so that they can come into contact with the concrete between the core irons supports integrated in the top plate. If, however, the cores are carried by a yoke, the pressing feet of the top part can be made in one piece corresponding to the top side of the product.

Another advantage of the invention is that the constituent core members may be built up from modules. These modules are hardened after the making. The modules are bolted together into core members which form the internal shape of the concrete block, and the core members are then bolted into the mould frame.

Furthermore, the use of bolts implies that the core members may rapidly and simply be exchanged in the mould frame. This may possibly occur simultaneously with the wear plates forming the external side of the concrete block are exchanged; these wear plates are also bolted to the mould frame.

By the invention is furthermore provided the possibility that the core member, whether bolted to the top plate or to the supporting yoke, may be flexibly bolted on by using a vibration dampening shim, which is preferably disposed between the intermediate pieces and the core members.

The said vibration dampening shim has the advantage that it is ensured that not all vibrations from the consolidation are transmitted to the core member support. By the slight flexibility inherent in the vibration dampening shim, it is simultaneously also achieved that the core can oscillate (vibrate) independently of the mould frame and thereby improve consolidation, resulting in that the surfaces of the cast items will appear more smooth. The vibration dampening shim implies that the core members can move slightly in relation to the mould frame, and that they can oscillate slightly differently from the mould frame, further ensuring that the core member/members are not subjected to quite so strong vibration during the consolidating vibration, thus safe-guarding the constituent core members.

As alternative to the 'flexible' bolting on of the core members attained by using the vibration dampening shim, the vibration dampening shim may be substituted by a compact spacer element, whereby the core members are rigidly connected to the mould frame.

DESCRIPTION OF THE DRAWING

The invention is then described briefly in more detail with reference to the drawing, on which:

On FIGS. 1 and 2 is shown moulding equipment 2 for a concreting machine. The bottom part 4 is shown lying on a casting board 28 on a not shown vibration table. The shown top part 14, cf. FIGS. 1 and 2, has a strong holding plate 16 to which is welded a number of downwards projecting support rods 18 that carry the pressing feet 20 bolted thereon, each having a contour corresponding to the top side shape of the concrete blocks 22 to be cast. The pressing feet 20 will thus together form a bottom plate broken by a pattern of slits between the pressing plates, and this pattern will correspond to the shape of the open cells 6 which appear in the associated bottom part 4 which thus display the mentioned casting cells 6 that are open both upwards and downwards.

Figure 1:
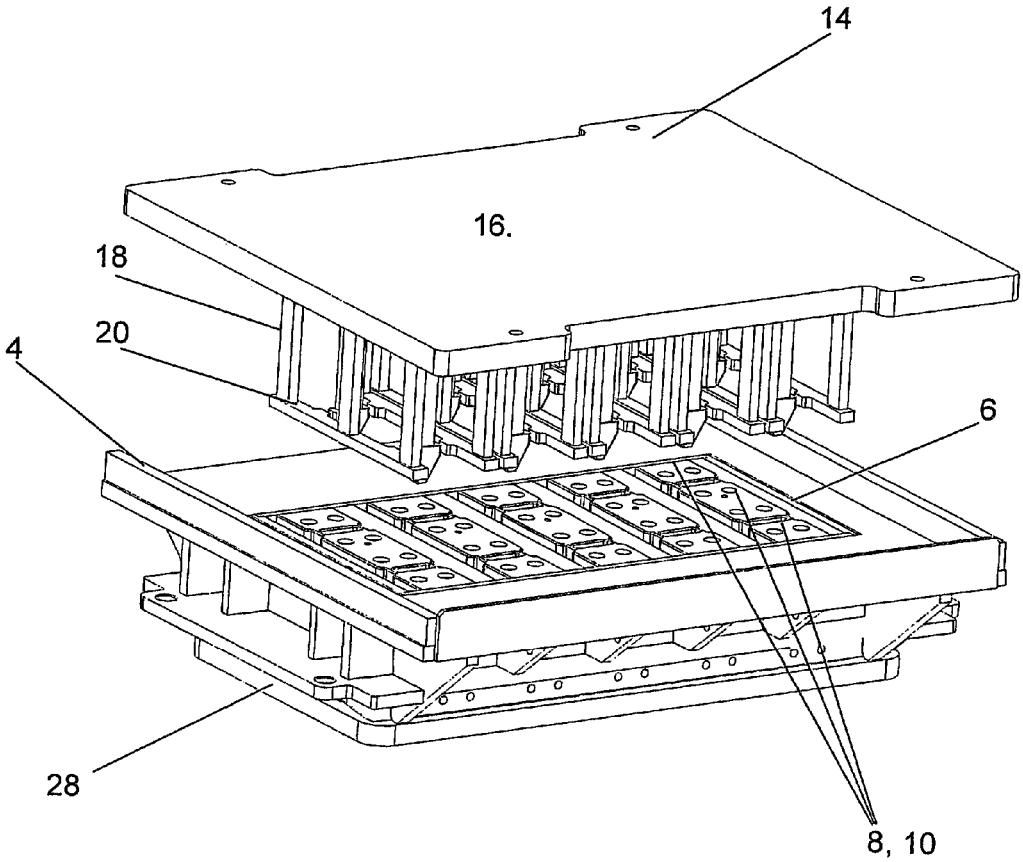
FIG. 1 is a perspective view of a moulding equipment, where a mould top part is elevated above a mould bottom part, and where the core supports are integrated in the top plate.
Figure 2:
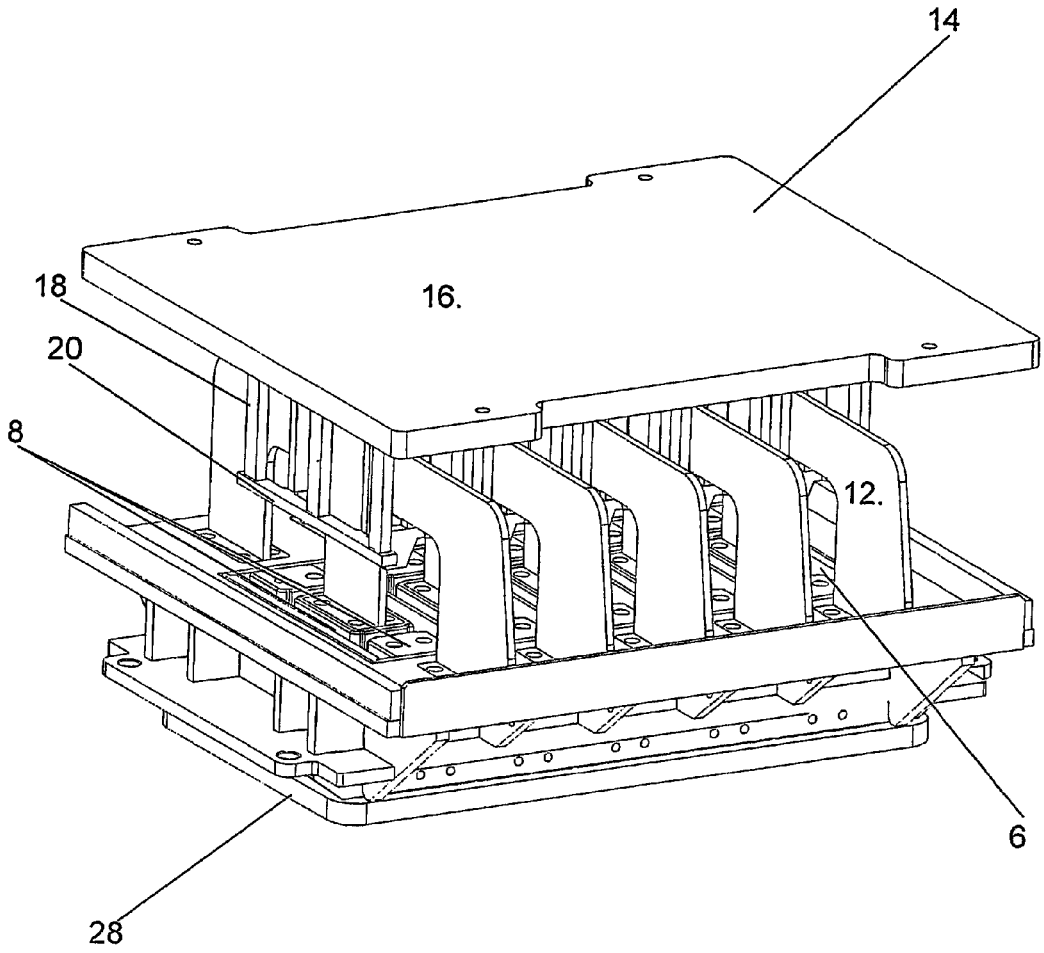
FIG. 2 is a perspective view of mould equipment where a mould top part is elevated above a mould bottom part, and where the core supports are built up as a yoke.

The moulding equipment 2 shown in FIGS. 1 and 2 are shown with the top part 14 elevated above the mould bottom part 4, ready for filling casting material (concrete). After filling concrete into the cells 6 and vibration at the vibrating table (not shown) with the pressing feet 20 of the top part inserted in the cells 6 and in contact with the items 22, it is actual to strip the items 22, in practice by elevating the bottom part 4 with the top part 14 retained, whereby the pressing feet 20 will hold the items 22 down onto the casting board 28, as it appears from FIG. 7.

Figure 3:
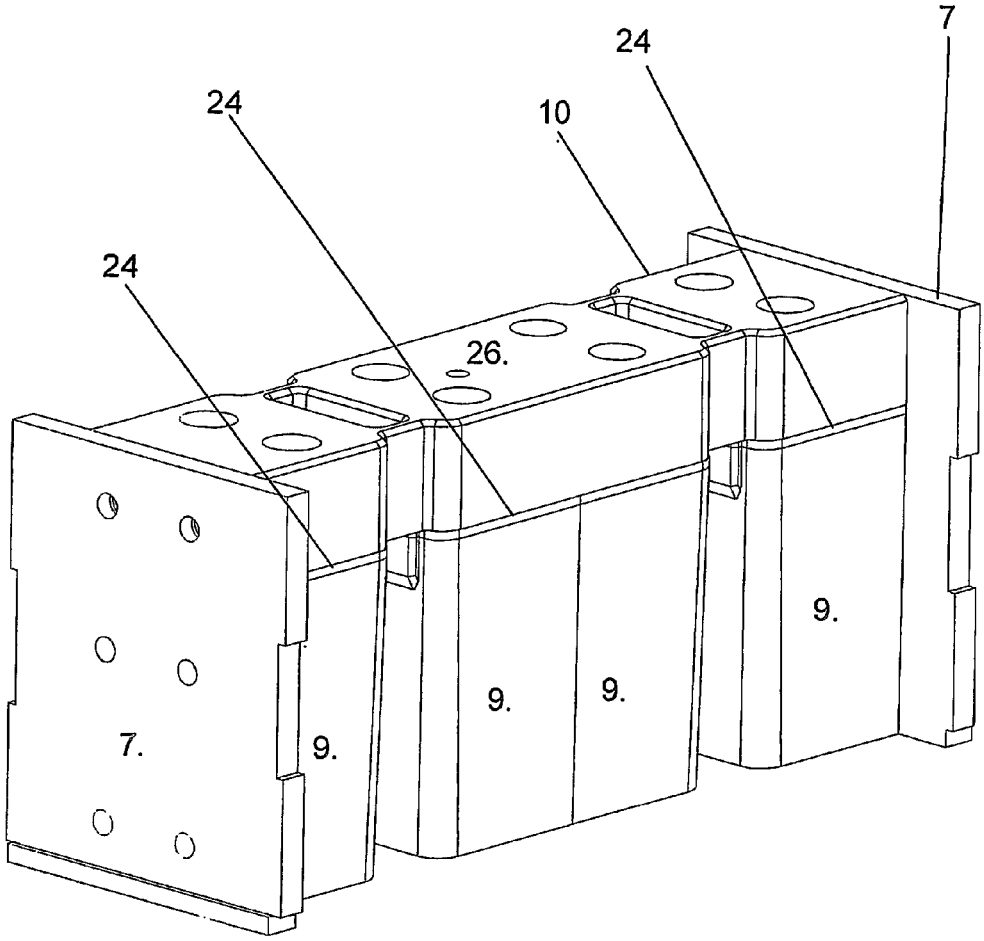
FIG. 3 is a perspective view of a first embodiment of a core support integrated in the top plate according to the invention, bottom part not shown.
Figure 4:
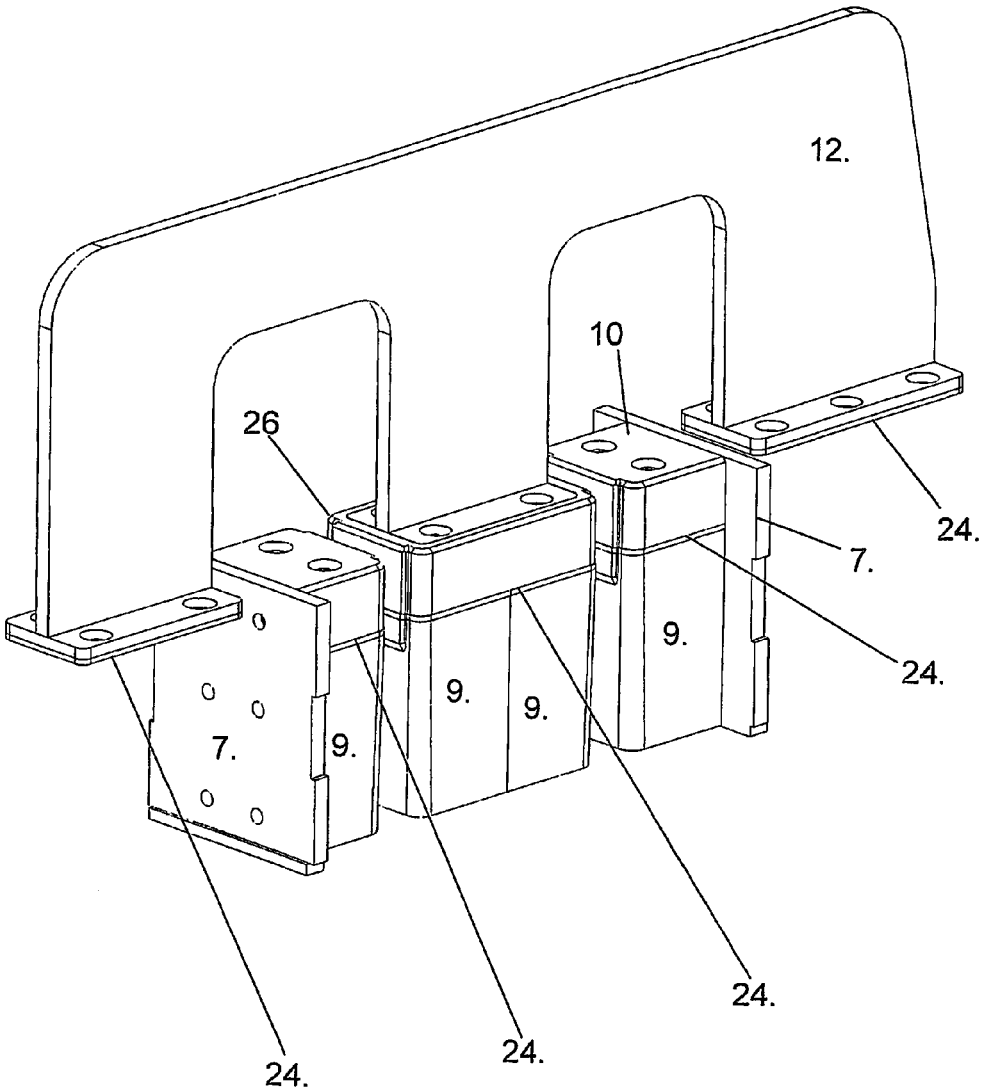
FIG. 4 is one of a second embodiment of a core support structured as a yoke according to the invention, bottom part not shown.

FIGS. 3 and 4 are perspective views of the core member structure for the first embodiment of a core support integrated in the top plate 10 according to the invention, and a second embodiment of a core support with structure as a yoke 12 according to the invention, respectively. Here, it appears that the two outermost semi-cores 9 are securely bolted together with the end gable 7 to the mould frame. The vibration dampening shim 24 is seen here, providing that the intermediate cores, which consist of two semi-cores 9 bolted together, have little flexibility in relation to the mould frame. This vibration dampening shim 24 may alternatively be substituted with a compact shim, whereby the core elements are entirely secured to the mould frame.

Figure 5:
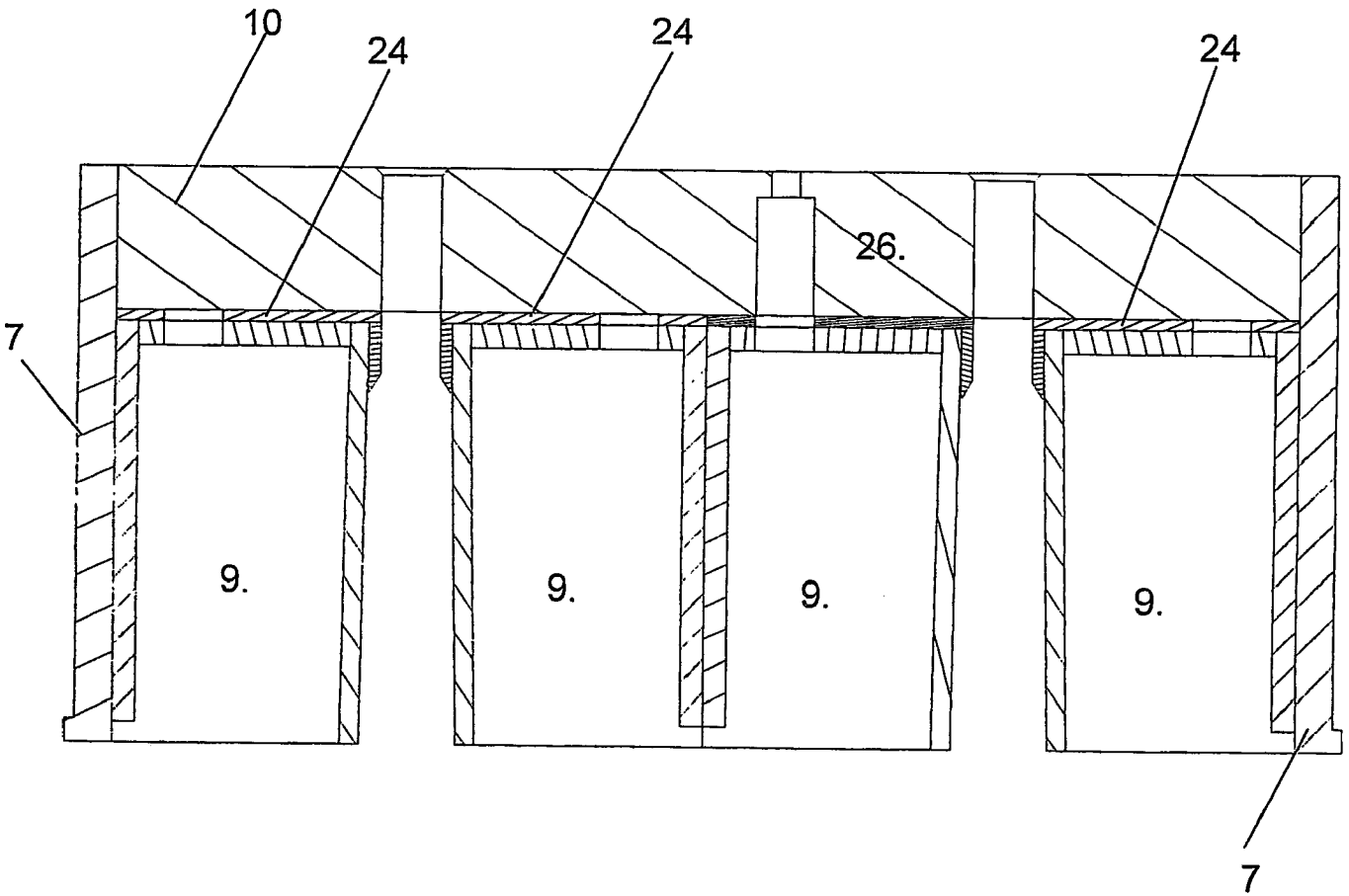
FIG. 5 is a combined side sectional view and side view of the embodiment shown in FIG. 3, bottom part not shown.
Figure 6:
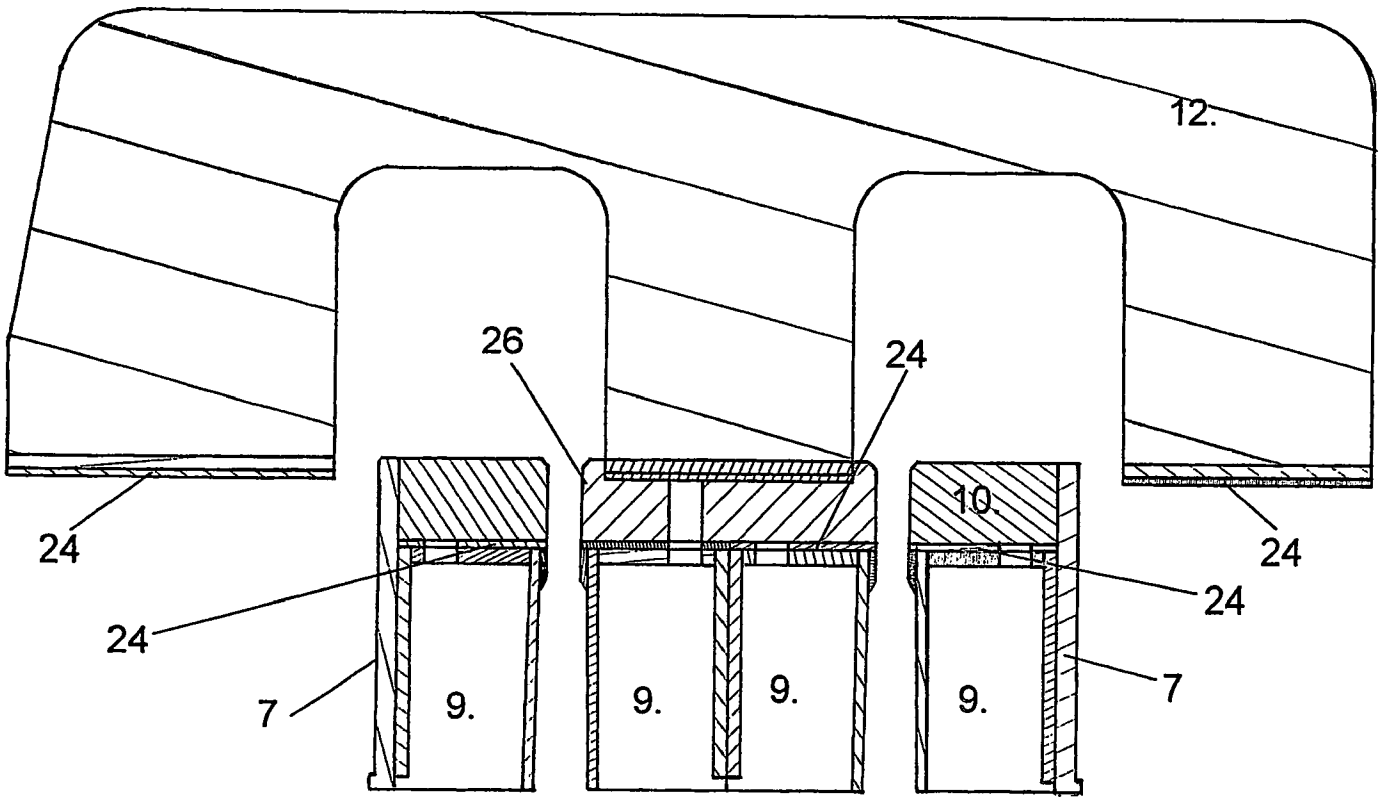
FIG. 6 is a combined side sectional view and side view of the embodiment shown in FIG. 4, bottom part not shown.

In FIGS. 5 and 6 are found a combined side and side sectional view of the core element structure for the first embodiment of a core support integrated in the top plate 10 according to the invention and a second embodiment of a core support structured as a yoke 12 according to the invention, respectively. These views also depict the vibration dampening shim 24.

Figure 7:
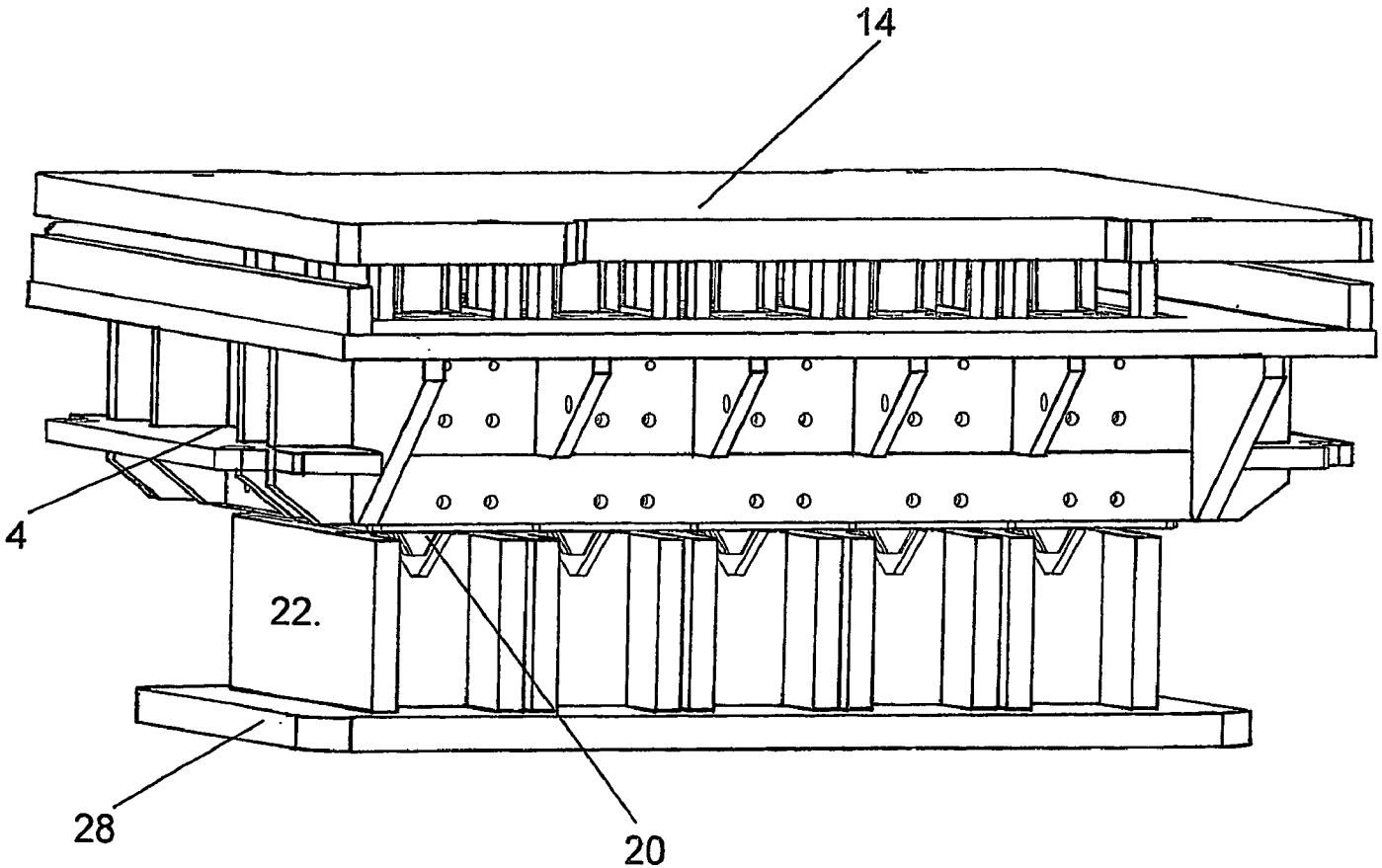
FIG. 7 is a perspective view of stripped concrete blocks for the embodiment shown in FIGS. 1, 3 and 5.

In FIG. 7 is illustrated a newly cast item 22 right after stripping. At the stripping the newly cast items 22 remain standing on the casting board 28 when the bottom part 4 of the mould 2 is lifted. By this movement of the bottom part 4 relative to the top part 14, the pressing pistons 18 are kept in their position in relation to the cast item 22, so that the cast item 22 is pressed out of the bottom mould part 4 and thus remain standing on the casting board 28. The pressing feet 20 arranged at the underside of the top part 14 and/or the pressing pistons 18 thus press the pre-cast item out of the mould. This is further facilitated by the cores 8, 9 being designed with bevelling. By subsequently withdrawing the top part 14 with pressing pistons 18 and pressing feet 20 from the bottom part 4, the newly cast item 22 may then be transported out the machine on the casting board, and the bottom part 4 lowered down to a new casting board 28, after which the mould 2 is ready for a new casting cycle, possibly after applying release agent and/or mould oil.

List of Reference Numbers:

2 moulding equipment
4 bottom part

6 open cells
7 end gable in cells
8 cores
9 semi-core
10 top plate for cores
12 yoke for cores
14 top part
16 top part holding plate
18 pressing pistons
20 pressing feet
22 cast items
24 vibration dampening shim
26 intermediate pieces
28 casting board

The invention claimed is:

1. Moulding equipment (2) for concreting machines of the kind typically used for making cast items with cavities or corings in the shape of concrete blocks for erecting walls and elements, including a cellular bottom part (4) with cells (6) opening upwards as well as downwards which define the desired basic shape of the individual blocks and elements, and where the bottom part (4) includes at least one core member (8) placed in respective cells where the said cavities/corings in the mould are desired to be disposed, and a corresponding top part (14) which has pressing pistons (18) projecting downwards from an upper holding plate (16) and formed with lower pressing plates (20) that fit down into respective underlying cells (6) in the bottom part (4) and are thereby usable for downwards ejection of the cast items from the cells (6), and where the bottom part (4) includes means ensuring that the core members (8) keep their position in the bottom part (4), characterized in that the means ensuring that the core members (8) keep their position in the bottom part (4) are constituted by at least one top plate (10) supported by and releasably fastened to the bottom part (4), and that the core members (8) are fastened to the top plate (10), preferably by bolt connections such that between the core members (8) and the intermediate pieces (26) there is a vibration dampening shim (24).

2. Moulding equipment (2) according to claim 1, characterized in that between the top plate (10) and the core members (8) there are one or more intermediate pieces (26).

3. Moulding equipment according to claim 2, characterized in that the pressing plates (20) in the top part (14) are divided into several pieces.

4. Moulding equipment according to claim 3, characterized in that where top plate (10) carries core members (8) not in contact with wall sections of the open cells (6), it (10) is secured and supported by a yoke (12) which is supported and releasably fastened to the bottom part (4).

5. Moulding equipment according to claim 4, characterized in that the pressing plates (20) in the top part (14) are made as a single continuous piece.

6. Moulding equipment according to claim 5, characterized in that between the core members (8) and the intermediate pieces (26) there is a vibration dampening shim (24).

7. Moulding equipment according to claim 6, characterized in that between the core members (8) and the intermediate pieces (26) there is a compact shim (24).

8. Moulding equipment according to claim 1, wherein the pressing plates in the top part are divided into several pieces.

9. Moulding equipment according to claim 1, wherein the top plate carries core members which are out of contact with wall sections of the open cells, the top plate being secured and supported by a yoke which is supported and releasably fastened to the bottom part.

10. Moulding equipment according to claim 9, wherein the pressing plates in the top part are made as a single continuous piece.

11. Moulding equipment according to claim 1, wherein a vibration dampening shim is provided between the core members and the intermediate pieces.

12. Moulding equipment according to claim 1, wherein a compact shim is provided between the core members and the intermediate pieces.

* * * * *